US005961226A

United States Patent [19]

Nishida

[11] Patent Number: 5,961,226

[45] Date of Patent: Oct. 5, 1999

[54] PRINTING APPARATUS

[75] Inventor: Hajime Nishida, Hiratsuka, Japan

[73] Assignee: Ricoh Company, Ltd., Tokyo, Japan

[21] Appl. No.: 08/915,527

[22] Filed: Aug. 15, 1997

[30] Foreign Application Priority Data

Aug. 16, 1996 [JP] Japan ..... 8-216217

[51] Int. Cl.[6] ..... B41J 3/42

[52] U.S. Cl. ..... 400/70; 358/449; 400/708; 399/86; 399/370; 399/376

[58] Field of Search ..... 400/70, 708; 395/100; 358/449; 399/86, 82, 205, 370

[56] References Cited

U.S. PATENT DOCUMENTS

| | | | |
|---|---|---|---|
| 4,211,482 | 7/1980 | Arai et al. | 399/200 |
| 4,669,858 | 6/1987 | Ito et al. | 399/86 |
| 4,707,111 | 11/1987 | Inuzuka et al. | 399/209 |
| 4,835,572 | 5/1989 | Ide | 399/376 |
| 4,849,790 | 7/1989 | Ito | 399/82 |
| 5,061,962 | 10/1991 | Takahashi | 399/370 |
| 5,159,324 | 10/1992 | Ohtani et al. | 359/209 |
| 5,162,918 | 11/1992 | Muramatsu | 358/300 |
| 5,369,733 | 11/1994 | Arimoto et al. | 395/100 |
| 5,496,119 | 3/1996 | Kawakami et al. | 400/70 |
| 5,625,466 | 4/1997 | Nakajima | 358/449 |

OTHER PUBLICATIONS

Patent Abstracts of Japan, English language abstract of Japanese Publication No. 08036330, Feb. 6, 1996.

Patent Abstracts of Japan, English language abstract of Japanese Publication No. 08119463, May 14, 1996.

*Primary Examiner*—Eugene H. Eickholt

*Attorney, Agent, or Firm*—Cooper & Dunham LLP

[57] ABSTRACT

A printing apparatus capable of feeding standard and non-standard sheets so that image data can be printed on various types of sheets with the need for increasing the number of internal components. One embodiment for achieving this includes a sheet setting unit that permits selection of one of a plurality of predefined sheets, a sheet width sensor unit that senses whether sheets in a sheet supply member meet a predefined width, and a controller coupled to the sheet setting unit and the sheet sensor unit. The controller is responsive to either the selected one of the plurality of predefined sheets or user input of dimensional data of the sheets in the supply member. Based upon the set sheet type or input dimensional data, the controller then adjusts the magnification of the image to be printed and prints the image on the sheets.

13 Claims, 12 Drawing Sheets

FIG. 6

| CONDITION OF SWITCH (SWI , SW2) | | SHEET TYPE |
|---|---|---|
| ① | ② | |
| OFF | OFF | A4 |
| OFF | ON | A5 |
| ON | OFF | LT |
| ON | ON | LG |

FIG. 8

| CONDITION OF SWITCH (SWI , SW2) | | SHEET TYPE |
|---|---|---|
| ① | ② | |
| OFF | OFF | A4 |
| OFF | ON | A5 |
| ON | OFF | LT |
| ON | ON | OTHERS |

FIG. 12

| CONDITION OF SWITCH (SW1 , SW2) | | SHEET TYPE |
|---|---|---|
| ① | ② | |
| OFF | OFF | A4/EXE |
| OFF | ON | A5/U.S.No.10 |
| ON | OFF | LT/EUROPEAN |
| ON | ON | OTHERS |

START

S1001
SWITCH 22 IS TURNED ON ?
NO
YES
S1002
CHECK SHEET TYPE (A4, A5, LETTER, OTHERS)
S1007
CHECK SHEET TYPE (EXE, U.S. 10, EUR, OTHERS)
S1003
"OTHERS" ?
YES
YES
S1008
"OTHERS" ?
NO
NO
S1005
CHANGE TO MANUAL INPUT MODE
S1004
SET SHEET TYPE
S1009
SET SHEET TYPE
S1006
PRINT OUT
END

PRINTING APPARATUS

BACKGROUND

1. Field of the Invention

The present application relates to printing apparatus, such as printers, facsimile machines and copy machines. More particularly, the present application relates to printing apparatus having a sheet setting mechanism that permits the transfer of image data onto various sizes of paper sheets.

2. Description of the Related Art

Conventional printing apparatus typically use mechanical switches and/or optical sensors to detect the size of a sheet on which image data is to be printed. For example, Japanese Patent Laid-Open Publication No. 8-36330, discusses a conventional printer that uses more than one detector to determine the size of various sheets stored in a sheet cassette for subsequent printing. The printer then controls a printing operation of the printer based on the detected sheet size.

In such conventional printing apparatus, the number of detectable sheet sizes is related to the number of detectors. As a result, such printing apparatus are not readily adaptable to detect sheet sizes other than those in which the detectors are positioned to detect. The number of detectors can be increased but the number of components and additional circuitry needed to accommodate the increase in detectors, results in printing apparatus that are more complex and costly to manufacture.

SUMMARY

The present application provides a printing apparatus capable of feeding standard and non-standard sheets so that image data can be printed on various types of sheets with the need for increasing the number of internal components. One embodiment for achieving this includes a sheet setting unit that permits selection of one of a plurality of predefined sheets, a sheet width sensor unit that senses whether sheets in a sheet supply member meet a predefined width, and a controller coupled to the sheet setting unit and the sheet sensor unit. The controller is responsive to either the selected one of the plurality of predefined sheets or user input of dimensional data of the sheets in the supply member. Based upon the set sheet type or input dimensional data, the controller then adjusts the magnification of the image to be printed and prints the image on the sheets.

Preferably the sheet setting unit includes a user operable dial positioned adjacent at least one switch so that movement of the dial causes projections to selectively active the at least one switch associated with the selected one of the predefined sheets.

Preferably, the sheet width sensor unit includes a switch, and a lever interactive with the sheet supply member so that when sheets in the cassette engage the lever the switch is activated.

In an alternative embodiment, the printing apparatus includes a sheet cassette capable of supplying various type sheets, a sheet width sensor unit that detects whether a size of sheets in the cassette are smaller than a predefined width and outputs a signal at least when the sheets are smaller than the predefined width; a display unit that displays a list of sheet types for selection, and a controller electrically coupled to the sheet width sensor unit and the display unit. The controller is configured to adjust the magnification of images to be printed based on a selected sheet type selected by a user from the list if the sheet width sensor unit outputs a signal that indicates that the sheets have a width that is smaller than the predefined width.

BRIEF DESCRIPTION OF THE DRAWINGS

Preferred embodiments of the invention are described hereinbelow with reference to the drawings wherein:

FIG. 6 is a table showing a relationship between sheet setting unit settings and the type of sheet according to a first embodiment of the present application;

FIG. 8 is a table showing a relationship between sheet setting unit settings and the type of sheet according to a second embodiment of a present application;

FIG. 12 is a table showing the relationship between settings for the sheet unit and the type of sheet according to a fourth embodiment of the present application.

DETAILED DESCRIPTION

The printing apparatus according to the present application includes various types of machines capable of transferring image data onto sheets of paper. For the present application the printing apparatus discussed is a printer. However, the printing apparatus may be a facsimile machine, a copying machine, or the like. With reference to the accompanying figures, the preferred embodiments of the present invention will now be described.

Figure 1:
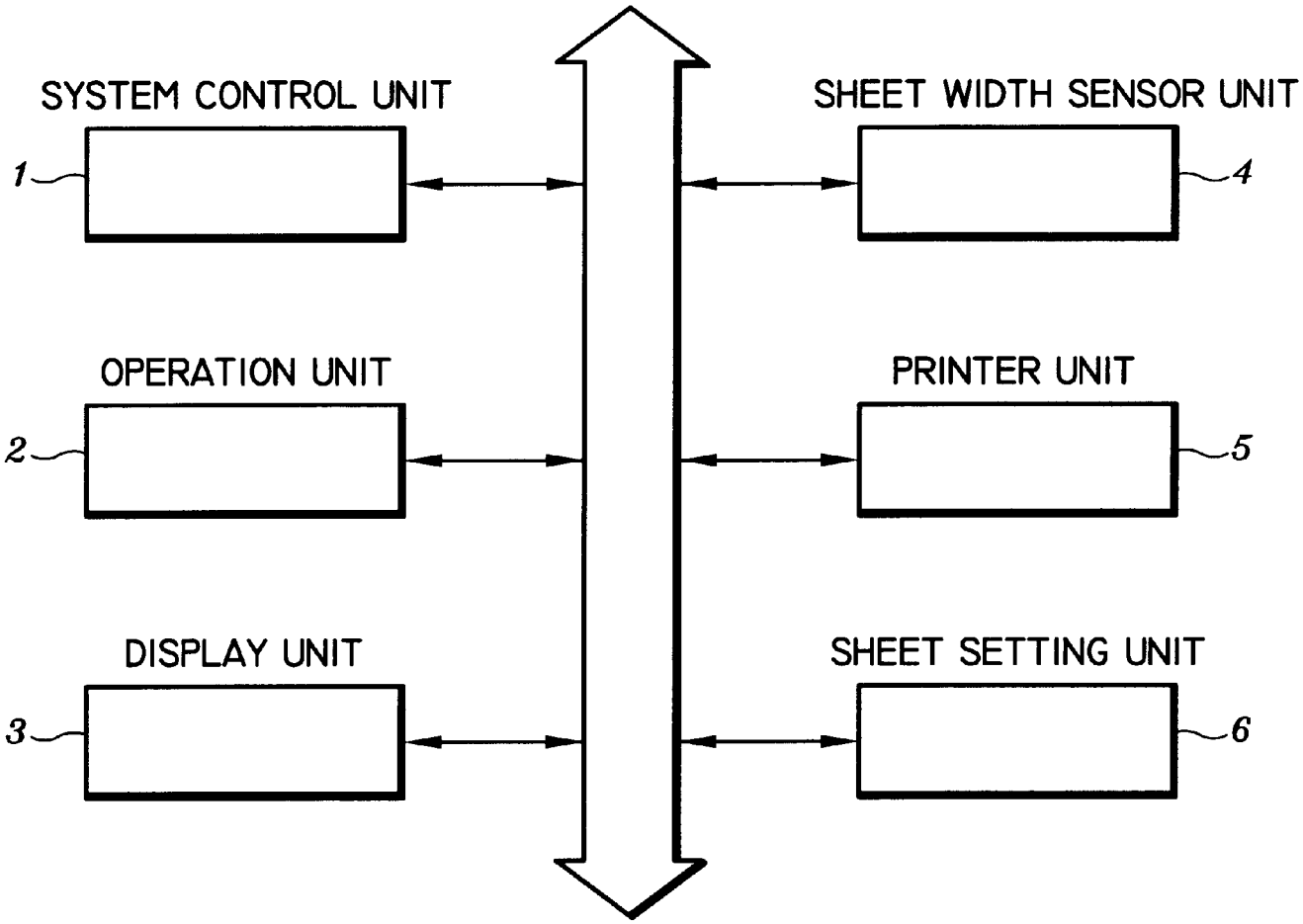
FIG. 1 is a functional block diagram of a printing apparatus with a sheet setting mechanism according to the present application.

Referring to FIG. 1, printing apparatus generally include a system control unit having a central processing unit (CPU), memory and stored programs (e.g., system and application programs stored in memory) to control operation of the apparatus and perform printing functions. Typically, the memory includes ROM and RAM. The RAM stores image data to be printed that is either internally generated or received from an external processing device, such as a personal computer. The system control unit 1 controls the functions of the printing apparatus and the input and output of image data to be printed for storage or printing.

The printing apparatus may also include an operation unit 2 that permits user interaction with the printing apparatus.

The operation unit may be keyboard 12 (seen in FIG. 2) or other data input device. A display unit 3, such as a liquid crystal display 13 (seen in FIG. 2) is provided to display user and status information. A printer unit 5 is provided to selectively print stored image data on sheets in a sheet supply unit.

The sheet setting mechanism of the present application includes sheet width sensor unit 4 and sheet setting unit 6 which are electrically coupled to the system control unit 1. The sheet width sensor unit 4 is used to determine whether the width of sheets in a sheet supply unit, such as cassette 18 seen in FIG. 2, meets a predefined width. That is, the sensor unit 4 determines whether the sheets have a width that is equal to or greater than the predefined width. The predefined width may be the width of a particular sheet, e.g., an A4 size sheet. The sheet setting unit 6 is provided to permit printing on predefined sheet types and/or non-defined sheet types.

Referring to FIGS. 2–5, an exemplary printing apparatus is shown. In these figures the printing apparatus is a printer 9 having a housing 10 for enclosing the internal components of the printer, and a keypad 12 and an LCD display 13 for user interaction with the printer. The sheet setting unit 6 includes, in this embodiment, a sheet select member, such as dial 11, for setting a sheet type and a sheet type switch unit 17 which is this embodiment consists of two switches (SW1, SW2). The dial 11 includes indicia representing selections for predefined and non-defined sheet types. For example, the dial may include the following indicia: A4, A5, LT and LG which are visible through the window 19 in cassette 18 of the printer. The dial 11 also includes projections 20 (seen in FIG. 3) positioned on a surface adjacent switch unit 17 so that when a projection engages a switch (SW1, SW2 or both) the state of the switch changes.

Figure 2:
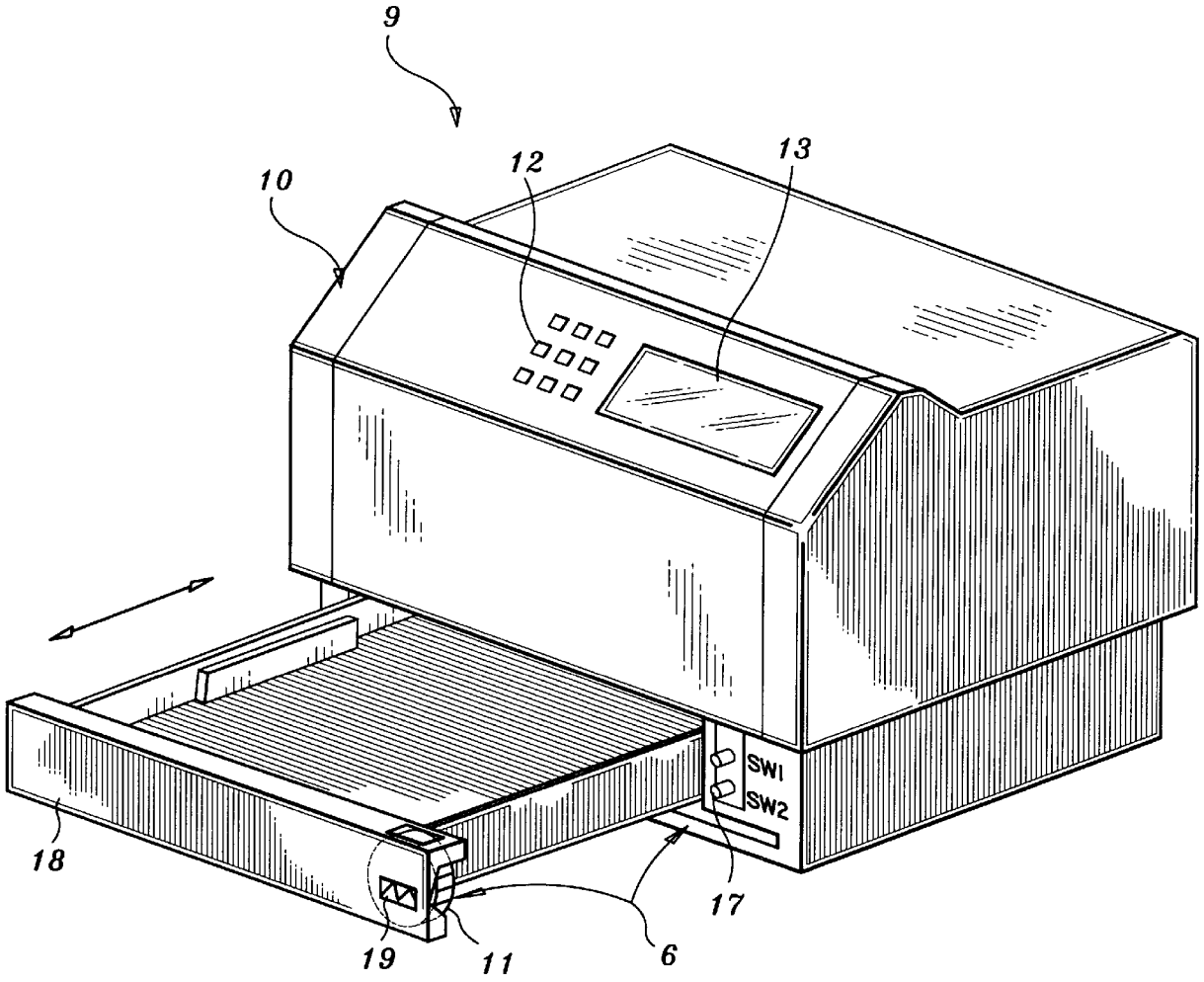
FIG. 2 is a perspective view of a printer with the sheet setting mechanism according to the present application.
Figure 3:
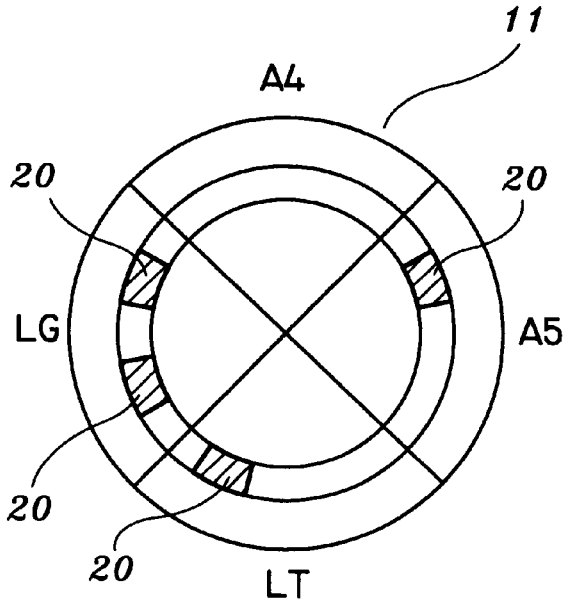
FIG. 3 is a rear elevational view of a sheet select member illustrating projections for actuating control switches associated with the sheet setting mechanism for the printer of FIG. 2.
Figure 4:
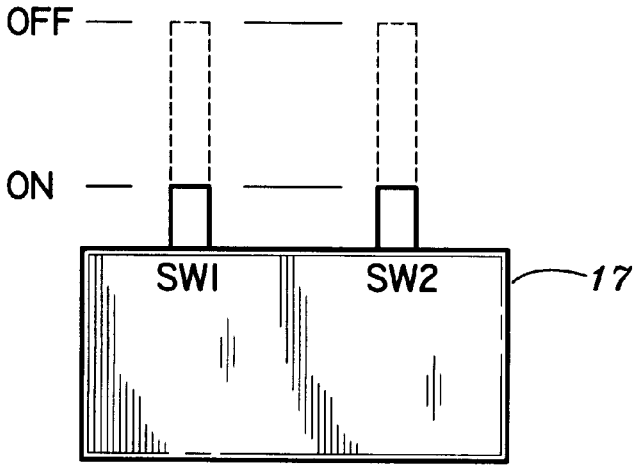
FIG. 4 is a side elevation view of a sheet setting unit associated with the sheet setting mechanism for the printer of FIG. 2.

In the embodiment of FIGS. 2 and 3 the projections are positioned so that depending on the sheet type selected none, both or one of the switches are activated. To illustrate, if the dial 11 is rotated so that the A4 setting is visible through window 19, no projections will engage the switches SW1, SW2 so that each switch is in an 'off' state. As seen in the table of FIG. 6, an 'off' state for each switch correlates to the A4 sheet type. If the dial 11 is rotated so that the A5 setting is visible through window 19, a projection 20 engages switch SW2 only so that switch SW1 is in an 'off' state and switch SW2 is in an 'on' state. As seen in the table of FIG. 6, this switch setting correlates to the A5 sheet type. If the dial 11 is rotated so that the LT (letter) setting is visible through the window, a projection 20 engages switch SW1 only so that switch SW1 is in an 'on' state and switch SW2 is in an 'off' state. As seen in the table of FIG. 6, these switch settings correlate to the letter sheet type. Lastly, if the dial is rotated so that the LG (legal) setting is visible through the window, projections 20 engage both switches SW1 and SW2 so that each switch is in an 'on' state. As seen in the table of FIG. 6, these switch settings correlate to the legal sheet type. The correlation data in the table is preferably stored in ROM.

Thus, in the embodiment discussed above, the determination of the sheet type in the sheet cassette 18 is based on the state of the switches SW1 and SW2 and the data in the table.

Figure 5B:
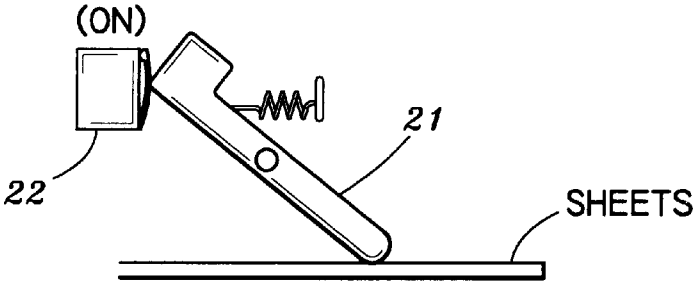
FIGS. 5*a*–5*c* are functional views for a sheet width sensor unit associated with the sheet setting mechanism for the printer of FIG. 2.
Figure 5C:
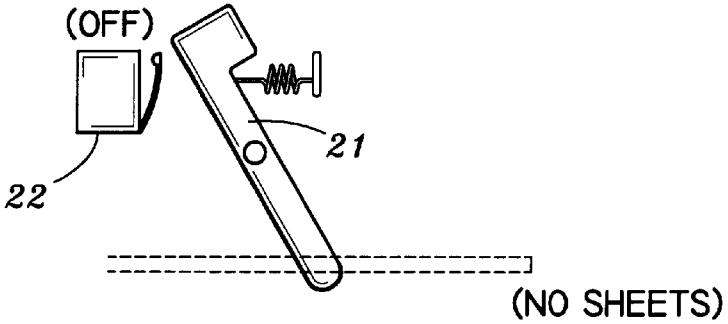
Figure 5A:
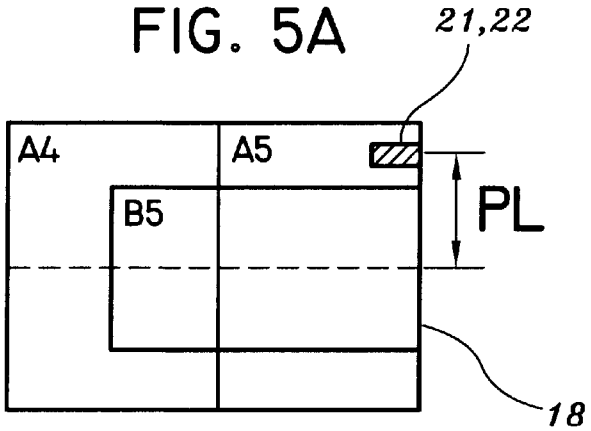

Referring now to FIGS. 5*a*–5*c* an exemplary sheet width sensor unit 4 is shown. As noted, sensor unit 4 detects whether the sheets in the sheet cassette have a width that is equal to or greater than a predefined width. In this embodiment, the sensor unit 4 includes a switch 22 electrically coupled to the system control unit 1 and a lever 21 that interacts with switch 22 and the cassette 18. When the switch 22 is in an 'on' state a signal is provided to the system control unit 1 indicating that the sheets in the cassette 18 have a width that is at least equal to the predefined width. Lever 21 extends into the sheet cassette 18 and pivots into and out of a position of engagement with the switch 22 which activates the switch 22 when at least one sheet in the cassette 18 has a width that is at least equal to the predefined width.

To illustrate, the lever 21 is pivoted up by sheets in the sheet cassette 18 so that the lever 21 turns on the switch 22 if the width of sheet meets the predefined width PL. Thus, in accordance with this embodiment, the system control unit 1 determines the sheet type in the cassette 18 based on the condition of the switches SW1 and SW2 and switch 22 and the data in the table of FIG. 6.

In the embodiment of FIG. 5, the predefined width PL is set for the width of A4 type sheets. However, other sheet types may be used to define the predefined width. Further, although the sheet width sensor unit 4 is described as a switch and lever configuration, other types of sensor units may be utilized. For example, optical sensors such as photoelectric proximity sensors and pressure sensitive mechanisms may be utilized.

In the configurations described above, the system control unit 1 may adjust the image data to be printed for one of four predefined sheet types (e.g., A4, A5, LT, LG) using the switches SW1 and SW2 (or alternatively switches SW1 and SW2 and switch 22) and the data in the table.

Figure 7:
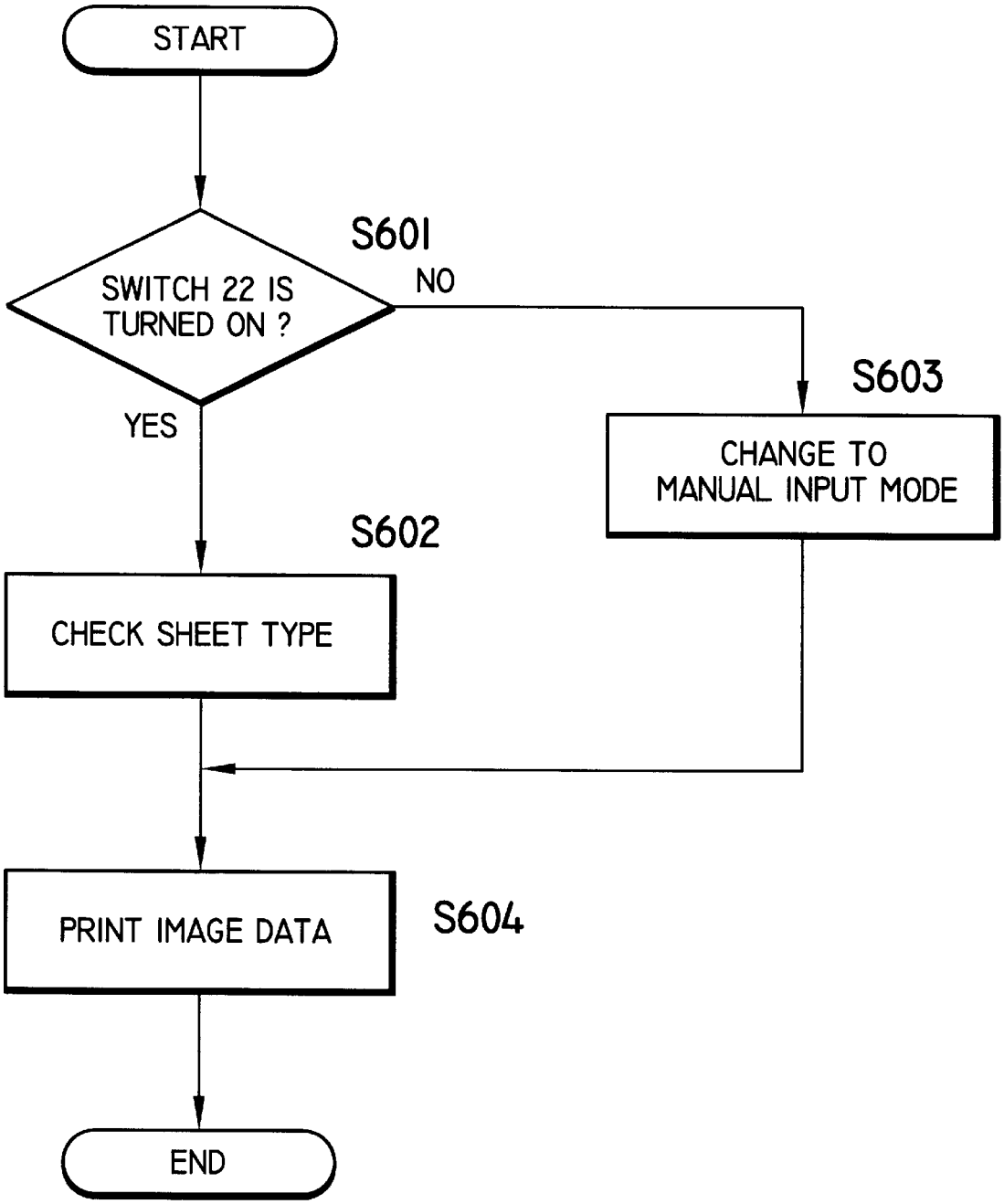
FIG. 7 is an operation flow chart for the operation of the sheet setting mechanism according to the first embodiment of the present application.

Referring to FIG. 7, an operation flow chart for the sheet setting mechanism using switches SW1, SW2 and switch 22 is shown. Initially, when the system control unit 1 receives a request signal to print from an internal (e.g., a printing processor) or external source (e.g., a personal computer), the system control unit 1 determines whether the width of sheets in the cassette 18 is equal to or greater than the predefined width PL by determining the state of switch 22 (step S601). If the sheet activates switch 22 (i.e., switch 22 is in the 'on' state), the system control unit 1 checks the sheet type setting of the dial 11 by determining the state of switches SW1 and SW2 (step S602). Based upon the setting of these switches, the system control unit 1 adjusts the magnification of the image to be printed so that the printed image corresponds to the sheet type, and controls the printer unit 5 (seen in FIG. 1) to print the image data on the sheet (step S604). Adjusting the magnification of the image includes reducing or enlarging the image to be printed.

In step S601, if the sheets do not activate switch 22 the sheet has a width that is less than the predefined width. In response, the system control unit 1 changes to a manual input mode of operation to permit a user to manually set the sheet type (step S603). When in the manual input mode, the display unit 3 displays a message informing the user that the printer is in the manual input mode for selecting the sheet type, and instructs the user to enter dimensional data (e.g., the length and width) of the sheets in the cassette. After the user enters the dimensional data, the system control unit 1 adjusts the magnification of the image to be printed as discussed above, and controls the printer unit 5 to print the image on the sheet (step S604).

In accordance with the this embodiment of the present application, the system control unit 1 automatically prints the image data in response to the set sheet type if the sheets have a width sufficient to activate switch 22. The embodiment discussed above has fixed sheet types and if the sheets in cassette 18 do not fall within one of these types then the system control unit 1 switches to the manual input mode. Thus, in this embodiment, sheets having a width sufficient to activate switch 22 which are not one of the selectable sheets indicated on the dial 11 (e.g., A4, A5, Letter or Legal) cannot be used.

Figure 9:
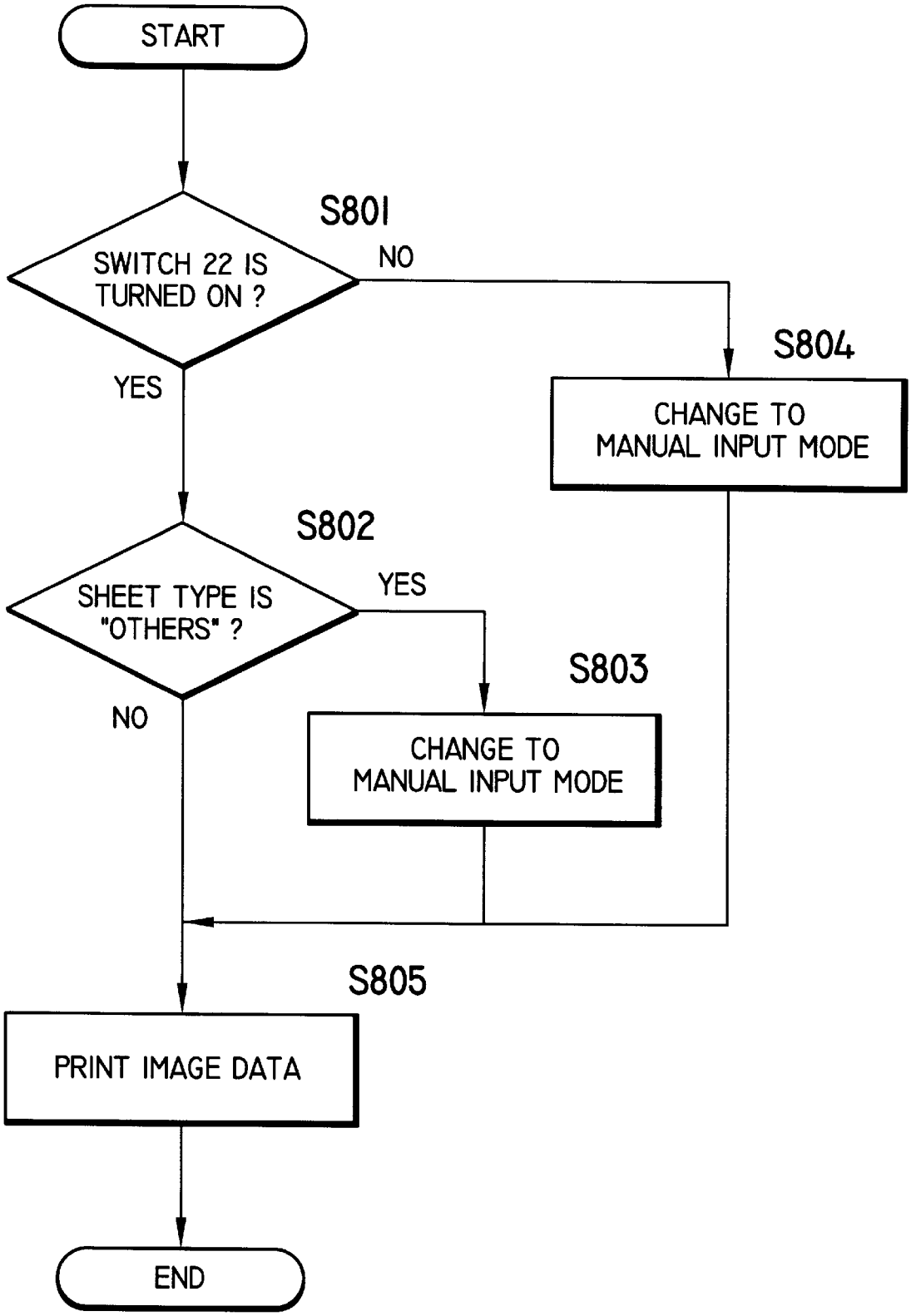
FIG. 9 is an operation flow chart for the operation of the sheet setting mechanism according to second embodiment of the present application.

Referring now to FIGS. 8 and 9, a second embodiment of the operation of sheet setting mechanism is shown. FIG. 8 illustrates a table defining the relationship between the sheet type and the state of the switches SW1 and SW2 in the switch unit 17. FIG. 9 is an operation flow chart for the sheet setting mechanism using switches SW1, SW2 and switch 22.

In this second embodiment of the operation of the sheet setting mechanism one of a plurality of predefined sheets (e.g., A4, A5 and letter) may be used. In addition, non-defined sheet types may also be used. In this configuration, the dial 11 would include indicia visible through window 19 for using the predefined sheet types. Such indicia may be 'A4', 'A5', and 'LT'. The dial would also include indicia for using non-defined sheet type. Such indicia may be 'others'.

FIG. 8 illustrates a table list used with the second embodiment for the operation of the sheet setting mechanism to define a relation between sheet type and a condition of the switches SW1 and SW2. Thus, the system control unit 1 can recognize the sheet type, e.g., A4, A5, Letter and others, in the sheet cassette 18 based on the condition of the switches SW1 and SW2, and switch 22. As discussed above, projections 20 are used to activate the switches SW1 and SW2 to select the sheet type.

Referring now to FIG. 9 an operation flow chart for the operation of the sheet setting mechanism according to the second embodiment is provided. Initially, when the system control unit 1 receives a request signal to print from an internal or external source, the system control unit 1 determines the state of switch 22 (step S801). If the width of the sheets in the cassette meet the predefined width PL so that the switch 22 is in the "on" state, the system control unit 1 determines which sheet type is being used by determining the condition of switches SW1 and SW2 (step S802). If one of the predefined sheet types are selected with dial 11 and the sheet width sensor, here switch 22, is active (or in the "on" state), the system control unit 1 proceeds to adjust the magnification of the image to be printed to correspond to the selected sheet type, and controls the printer unit 5 to print the image data on the sheets in the cassette 18 (step S805).

If in step S802, the selected sheet type is for a non-defined sheet, i.e., dial 11 is set to 'others', the system control unit 1 changes to a manual input mode which permits the user to input dimensional data for the sheets in the cassette 18 (Step S803). That is, the display unit 3 displays, for example, a notification of manual input mode operation, and instructs the user to input the dimensional data for the sheet, e.g., length and width, using keyboard 12. The system control unit 1 then proceeds to adjust the magnification of the image to be printed to correspond to the dimensional data for the sheets inputted by the user, and controls the printer unit 5 to print the image data on the sheets in the cassette 18 (step S805).

Returning to step S801, if the sheets in the cassette 18 have a width that is less than the predefined width PL so that the switch 22 is in the "off" state, the system control unit 1 changes to a manual input mode to permit the user to enter the dimensional data for the sheet using keyboard 12 (step S804). Once the dimensional data is entered, the system control unit 1 adjusts the magnification of the image as described above, and controls the printer unit 5 to print the image data (step S805).

A third embodiment for the operation of the sheet setting mechanism for the printing apparatus provides a selection list of other sheet types which permits a user to select one type from the list before requiring the user to input the dimensional data for the sheets in the cassette. In this embodiment, one of a plurality of predefined sheets, such as A4, A5 and Letter sheets, may be used. In addition, non-defined sheet types may also be used in the cassette. Similar to the above-described embodiment, the dial 11 would include indicia for using the predefined sheet types and indicia for using non-defined sheet types.

Figure 10:
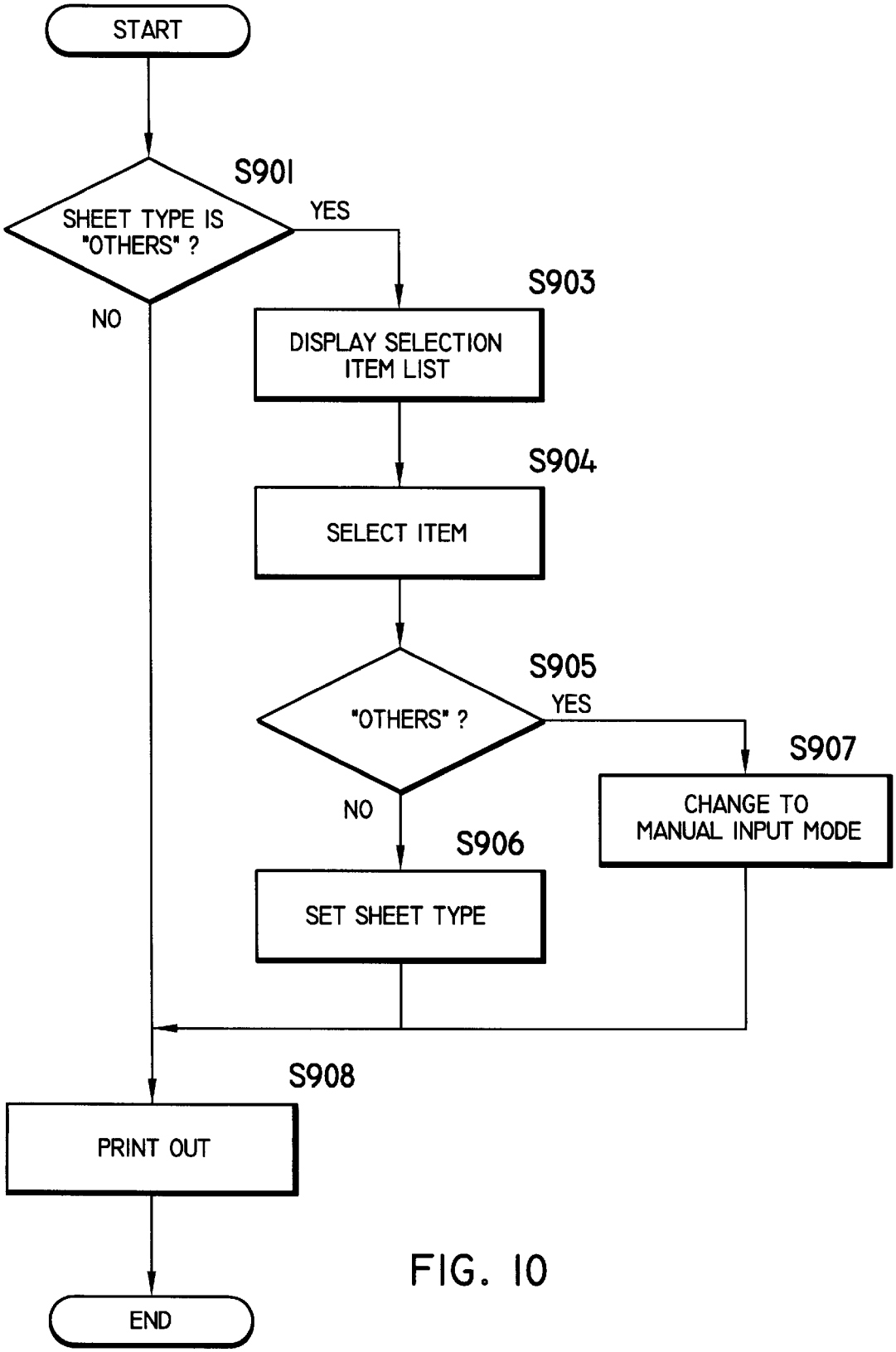
FIG. 10 is an operation flow chart for the operation of the sheet setting mechanism according to the third embodiment of the present application.

Referring to FIG. 10 an operation flow chart for the sheet setting mechanism of the printer according to the third embodiment is provided. Initially, when the system control unit 1 receives a request signal to print, the system control unit 1 determines if predefined or non-defined sheet types have been selected by checking the state of switches SW1 and SW2 (step S901).

If one of the predefined sheet types (e.g., A4, A5 or LT) is selected with dial 11 and the sheet width sensor, here switch 22, is active, the system control unit 1 proceeds to adjust the magnification of the image to be printed to correspond to the selected sheet type. After the image data is adjusted, the printer unit 5 proceeds to print the image data on the sheets in the cassette 18 (step S908).

Figure 11:
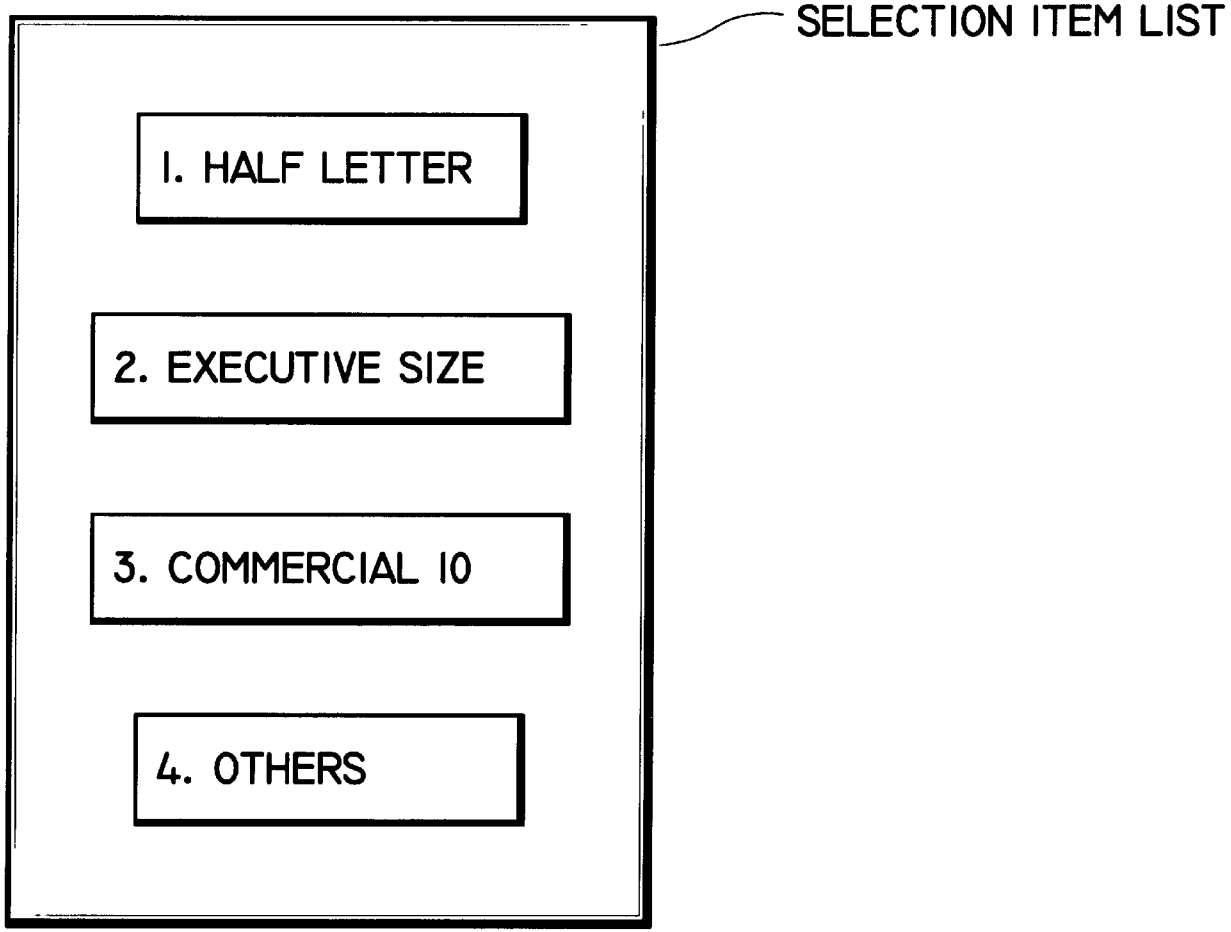
FIG. 11 is a functional block diagram of a display on the printer of FIG. 2 displaying sheet information in a manual input mode according to the third operational embodiment.

If in step S901, the selected sheet type is for a non-defined sheet, i.e., dial 11 is set to 'others', the system control unit 1 changes to a manual input mode which permits the user to select from one of a plurality of listed sheet types (step S903). That is, the display unit 3 displays, for example, a notification of manual input mode operation, and displays a listing seen in FIG. 11, of sheet types which may be selected by the user (step S904). Examples of sheet types that may be listed include 'half letter', 'Executive', 'U.S. No. 10 envelopes', and 'others'. If the select sheet type is a defined sheet, the system control unit 1 then proceeds to adjust the magnification of the image to be printed to correspond to the sheet type selected by the user (steps S905 and S906), and controls the printer unit 5 to print the image data on the sheets in the cassette 18 (step S908).

Returning to step S905, if the selected sheet type is for a non-defined sheet, i.e., the user selects 'other' displayed on display unit 3, the control unit changes to manual input mode (step S907). As described above, in this manual input mode the display unit instructs the user to enter the dimensional data for the sheets, and the control unit adjusts the magnification of the image and controls the printer unit 5 to print the image data (step S908).

A fourth embodiment for the operation of the sheet setting mechanism for the printing apparatus permits selection of an increased number of predefined sheet types, and non-defined sheet types. In this fourth embodiment, the system control unit 1 may detect seven sheet types: A4; A5; letter; executive; U.S. No. 10 envelopes; European DL envelopes; and others. Therefore, the dial 11 includes indicia for selecting one of the seven sheet types. Such indicia may include: 'A4/Exe'; 'A5/U.S. No.10'; 'LT/European' and 'others'.

To distinguish between A4 and Executive sheets the state of the sheet width sensor unit, here switch 22, is used. To illustrate, the system control unit 1 recognizes that the sheet type is A4 if the switch 22 is in the 'on' state and the dial 11 is set to 'A4/Exe'. On other hand, the system control unit 1 recognizes that the selected sheet type is Executive if the switch 22 is in the 'off' state and the dial 11 is set to 'A4/Exe'. Distinguishing the other sheet types indicated on dial 11 is achieved in a similar manner.

FIG. 12 provides a table for defining a relationship between the sheet type and the state of the switches SW1 and SW2. In this embodiment, the system control unit 1 recognizes the sheet type in the sheet cassette 18 based on the condition of the switches SW1 and SW2, switch 22 and the data in the table.

Figure 13:
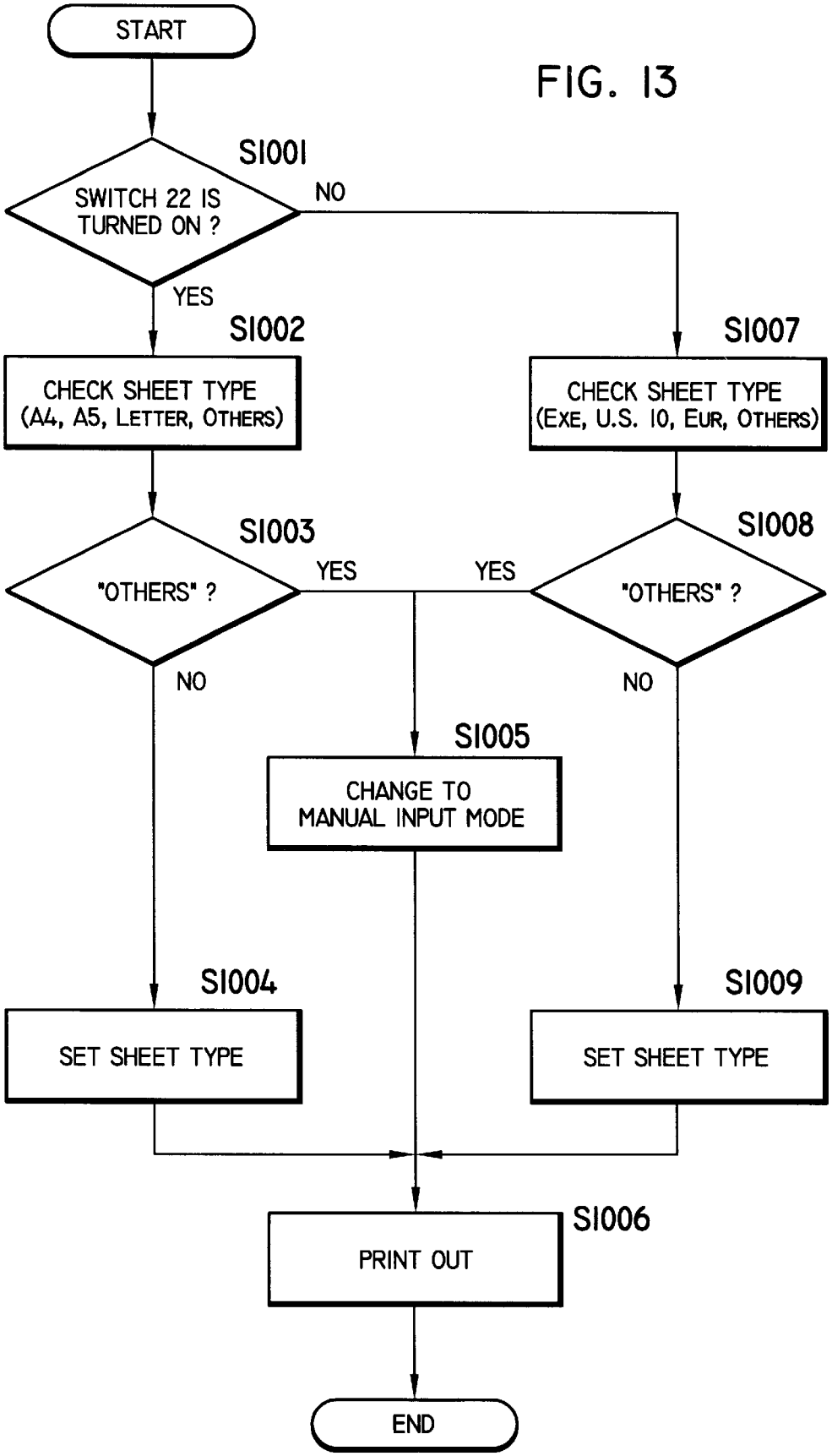
FIG. 13 is an operation flow chart for the operation of the sheet setting mechanism according to the fourth embodiment.

Referring now to FIG. 13, an operation flow chart of the sheet setting mechanism for the printing apparatus according to the fourth embodiment is shown. Initially, when the system control unit 1 receives a request signal to print from an internal or external source, the system control unit 1 determines the state of switch 22 (step S1001). If the width of the sheets in the cassette are equal to or greater than the predefined width PL so that the switch 22 is in the 'on' state, the system control unit 1 determines which sheet type (e.g., A4, A5, Letter or others) was selected on dial 11 by determining the state of switches SW1 and SW2 (steps S1002 and S1003).

If the sheet type selected is a predefined sheet (e.g., A4, A5, LT), the system control unit 1 proceeds to adjust the magnification of the image to be printed to correspond to the predefined sheet type selected (step S1004), and controls the printer unit 5 to print the image data on the sheets in the cassette 18 (step S1006).

If in step S1003, the selected sheet type is for a non-define 11 is set to 'others', the system control unit 1 changes to a manual input mode which permits the user to input dimensional data for the sheets in the cassette 18 (step S1005). That is, the display unit 3 displays, for example, a notification of manual input mode operation, and instructs the user to input the dimensional data for the sheet, e.g., length and width, using keyboard 12. The system control unit 1 then proceeds to adjust the magnification of the image to be printed to correspond to the dimensional data for the sheets inputted by the user, and controls the printer unit 5 to print the image data on the sheets in the cassette 18 (step S1006).

Returning to step S1001, if the sheets in the cassette 18 have a width that meets the predefined width PL so that the switch 22 is in the 'off ' state, the system control unit 1 determines which sheet type (e.g., Exe, U.S. 10, Eur or others) was selected on dial 11 by determining the state of switches SW1 and SW2 (step S1007 and S1008).

If the sheet type selected is a predefined sheet (e.g., Exe, U.S. 10, Eur), the system control unit 1 proceeds to adjust the magnification of the image to be printed to correspond to the predefined sheet type selected (step S1009), and controls the printer unit 5 to print the image data on the sheets in the cassette 18 (step S1006).

If in step S1008, the selected sheet type is for a non-defined sheet, i.e., dial 11 is set to 'others', the system control unit 1 changes to a manual input mode which permits the user to input dimensional data for the sheets in the cassette 18 (step S1005). That is, the display unit 3 displays, for example, a notification of manual input mode operation, and instructs the user to input the dimensional data for the sheet, e.g., length and width, using keyboard 12. The system control unit 1 then proceeds to adjust the magnification of the image to be printed to correspond to the dimensional data for the sheets inputted by the user, and controls the printer unit 5 to print the image data on the sheets in the cassette 18 (step S1006).

While the above provides a full and complete disclosure of the present application, various modifications, alternate constructions and equivalents may be employed without departing from the true sprit and scope of the invention. Therefore, the above description and illustration should not be construed as limiting the scope of the invention, which is defined by the appended claims.

What is claimed is:

1. A printing apparatus capable of using standard and non-standard sheets, comprising:

a sheet setting unit that permits selection of one of a plurality of predefined sheets;

a sheet width sensor unit that senses whether sheets in a sheet supply member meet a predefined width; and a controller coupled to said sheet setting unit and said sheet sensor unit, said controller being responsive to either said selected one of said plurality of predefined sheets or user input of dimensional data of the sheets in said supply member, such that based upon the set sheet type or input dimensional data the controller adjusts the magnification of an image to be printed on the sheets and prints the image on the sheets.

2. The printing apparatus according to claim 1, wherein said sheet setting unit comprises a user operable dial positioned adjacent at least one switch such that movement of said dial facilitates selection of one of the predefined sheets.

3. A printing apparatus capable of using irregular sheets, comprising:

at least one sheet supply member for supplying various sheet types;

a sheet setting mechanism for setting a type of sheet in the at least one sheet supply member between predefined sheet types and non-defined sheet types; and a controller electrically coupled to the sheet setting mechanism and an operation unit, and configured to reduce or magnify an image to be printed based on user entered dimensional data of sheets in said sheet supply member if the sheet type is non-defined sheet type.

4. The printing apparatus according to claim 3, wherein said sheet setting mechanism comprises:

a sheet setting unit that permits selection of one of said predefined sheet types or said non-defined sheet types; and a sheet width sensor unit that senses whether sheets in said at least one sheet supply member meet a predefined width.

5. A printing apparatus capable of using irregular sheets, comprising:

a sheet cassette for supplying various type sheets;

a sheet width sensor unit that detects whether a size of sheets in said cassette are smaller than a predefined width and outputs a signal at least when the sheets are smaller than said predefined width;

a controller electrically coupled to said sheet width sensor unit and responsive to said output signal such that said controller adjusts the magnification of an image to be printed based on dimensional data of the sheets entered by a user using a keyboard if the output signal indicates that the sheets have a width that is smaller than the predefined width.

6. The printing apparatus according to claim 5, wherein said sheet width sensor unit comprises:

a switch; and a lever interactive with said cassette such that when sheets in the cassette engage the lever said switch is activated.

7. A printing apparatus capable of using irregular sheets, comprising:

a sheet cassette capable of supplying various type sheets;

a sheet width sensor unit that detects whether a size of sheets in said cassette are smaller than a predefined width and outputs a signal at least when the sheets are smaller than said predefined width;

a display unit that displays a list of sheet types for selection;

a controller electrically coupled to said sheet width sensor unit and said display unit and configured to adjust the magnification of images to be printed based on a selected sheet type selected by a user from said list, if the sheet width sensor unit outputs a signal that indicates that the sheets have a width that is smaller than the predefined width.

8. A printing apparatus capable of using standard and non-standard sheets, comprising:

sheet setting means for permitting selection of one of a plurality of predefined sheets;

sheet width sensor means for sensing whether sheets in a sheet supply member meet a predefined width; and controller means coupled to said sheet setting means and said sheet sensor means, said controller means being responsive to either said selected one of said plurality of predefined sheets or user input of dimensional data of the sheets in said supply member, such that based upon the set sheet type or input dimensional data said controller means adjusts the magnification of an image to be printed on the sheets and prints the image on the sheets.

9. The printing apparatus according to claim 8, wherein said sheet setting means comprises a user operable dial positioned adjacent at least one switch such that movement of said dial facilitates selection of one of the predefined sheets.

10. A printing apparatus capable of using irregular sheets, comprising:

sheet supply means for supplying various sheet types;

sheet setting means for setting a type of sheet in said sheet supply means between predefined sheet types and non-defined sheet types; and controller means electrically coupled to the sheet setting means and operation means for reducing or magnifying an image to be printed based on user entered dimensional data of sheets in said sheet supply means if the sheet type is non-defined sheet type.

11. The printing apparatus according to claim 10, wherein said sheet setting means comprises:

sheet setting means for selecting one of said predefined sheet types or said non-defined sheet types; and sheet width sensor means that senses whether sheets in said sheet supply means meet a predefined width.

12. A printing apparatus capable of using irregular sheets, comprising:

sheet cassette means for supplying various type sheets;

sheet width sensor means for detecting whether a size of sheets in said cassette means are smaller than a predefined width and for outputting a signal at least when the sheets are smaller than said predefined width;

controller means electrically coupled to said sheet width sensor means and responsive to said output signal, for adjusting the magnification of an image to be printed based on dimensional data of the sheets entered by a user if the output signal indicates that the sheets have a width that is smaller than the predefined width.

13. The printing apparatus according to claim 12, wherein said sheet width sensor means comprises:

a switch; and a lever interactive with said cassette means such that when sheets in the cassette means engage the lever said switch is activated.

* * * * *